US005078403A

United States Patent [19]

Chernowski, Jr.

[11] Patent Number: 5,078,403

[45] Date of Patent: Jan. 7, 1992

[54] CARD GAME COMPONENTS AND METHOD OF PLAY

[76] Inventor: Michael P. Chernowski, Jr., 3826 23rd Ave., West, Seattle, Wash. 98199

[21] Appl. No.: 495,336

[22] Filed: Mar. 19, 1990

[51] Int. Cl.[5] ..... A63F 3/00

[52] U.S. Cl. ..... 273/269; 273/236; 273/273; 273/292; 273/299

[58] Field of Search ..... 273/236, 269, 271, 273, 273/292, 299-306, 148 A; 434/128, 129

[56] References Cited

U.S. PATENT DOCUMENTS

| | | | |
|---|---|---|---|
| 1,723,377 | 8/1929 | Salomon | 273/269 |
| 2,801,855 | 8/1957 | Clay et al. | 273/236 |
| 4,006,905 | 7/1977 | Marbury | 273/148 A |
| 4,560,171 | 12/1985 | Anthony | 273/269 |
| 4,577,869 | 3/1986 | Brinkman | 273/269 |
| 4,883,636 | 11/1989 | Fantle, Jr. | 273/269 |

*Primary Examiner*—Edward M. Coven
*Assistant Examiner*—Raleigh W. Chiu
*Attorney, Agent, or Firm*—Cassidy, Vance & Tarleton

[57] ABSTRACT

Card game components comprising a playing board (10), a series of program cards (24), and a set of input cards (34). Input cards (34) are randomly drawn from a draw pile area (12) and placed in a memory area (16) according to the order indicated on a program card (24) in the program card area (14). Input cards (34) not immediately playable are placed in a temporary storage area (18). Input cards (34) may be taken from the temporary storage area (18) as they become playable in any one of the four segments (20) of the memory area (16). The program card (24) contains four columns (30) of a series of characters (32) arranged in a non-repetitive sequence that is unique from other series on the card (24).

8 Claims, 3 Drawing Sheets

CARD GAME COMPONENTS AND METHOD OF PLAY

TECHNICAL FIELD

The present invention relates to card games, and, more particularly, to a card game having as its object the reordering of randomly drawn cards into two or more series of cards, each series having a unique non-repetitive sequence.

BACKGROUND OF THE INVENTION

Card games are useful for amusement, entertainment, and education. Most card games typically require two or more players who play against each other to determine a winner. There are, however, a few card games that require or can be played by only one player.

One well-known game for one player, commonly referred to as solitaire, is played with a deck of face cards. Most decks of face cards typically have four suits of thirteen cards each, beginning with numbered cards two through ten, a jack, queen, king, and an ace. The object of the game is to randomly draw cards from the deck and place them face up on a playing surface in four columns corresponding to the four suits. The rules of the game require that cards be placed in their respective suit in ascending or descending order. If a card drawn from the deck cannot be played in one of the four suits, it is either placed in a discard pile or placed back into the deck where it can be later drawn and played. Depending on the rules, it is possible to either complete the game or to reach a point where there are not more cards to be drawn and the unplayed cards in the discard pile are in an order such that it would be impossible to complete the four suits.

While this and other card games for one player provide some interest and challenge, they generally lack any educational value. For instance, the terminology and identifying characters used with the deck of the face cards described above is of ancient origin and, while interesting, provides no useful information to the player. Hence, there is a need for a card game designed for one player that provides education and intellectual stimulation as well as amusement and entertainment for not only adults but also children.

SUMMARY OF THE INVENTION

The present invention is directed to card game components and method of play for a single player having as its object the reordering of randomly drawn cards into two or more series of cards, each series having a unique non-repetitive sequence. More particularly, the card game playing components comprise at least two series of input cards, each of the input cards having a unique character printed thereon. Each character printed on the input cards belongs to a series of characters having a predetermined order. The components further comprise a program sheet having at least two series of characters printed thereon, each character being an identical match with each of the characters on the input cards. Each of the series of characters on the program sheet are arranged in a non-repetitive sequence that is unique from the other series of characters on the sheet.

In accordance with another aspect of the present invention, each series of characters on the input cards and each series of characters on the program sheet comprise thirteen unique characters.

In accordance with yet another aspect of the present invention, each character in each of the series of characters on the program sheet is one of an original series of characters that has a fixed order of arrangement such that each character has a fixed position in relationship to a first character of the series. Ideally, the fixed position is denoted by a position number such as one, two, three, etc. Furthermore, each series of characters on the program sheet of the program is arranged in a non-repetitive sequence that begins with a first character selected from the original series of characters. The first character will have a position number n in the original series of characters. The position number of the next character in the non-repetitive sequence will correspond to the sum of n+n. The position number of each succeeding character in the non-repetitive sequence is determined by adding the position number n of the first character to the position number of the previous character in the non-repetitive sequence. However, when the position number sum is greater than the position number of thirteenth character in the original series of characters, then the position number of the next succeeding character will be equal to the difference of the position number sum and the position of the thirteenth character in the series of characters having a fixed order of arrangement. In addition, the difference will be added to the position number of the character preceding the first character of the original series of characters having a fixed order of arrangement.

In accordance with a further another aspect of the present invention, the card game playing components include a playing board divided into at least four areas, with the areas comprising a first area sized and shaped to receive the program sheet, a second area sized and shaped to receive a pile of input cards, a third area sized and shaped to hold at least two piles of input cards, and a fourth area sized and shaped to receive at least two series of input cards arranged in overlapping relationship such that the character on each input card is at least partially visible to the player.

In accordance with a method of playing the game, with the card game components including at least two series of input cards and each series having at least thirteen cards with each card having a unique recognizable character printed thereon that corresponds to or matches a character in the other series, and a program card having at least two series of characters printed thereon in a non-repetitive sequence, with the characters being identical to the input card characters; the method comprises the steps of first mixing the input cards into a random order of arrangement and placing them into an input card draw pile; second, drawing a first input card from the input card draw pile; third, placing the drawn input card into a memory pile if the character on the drawn input card corresponds to the next character in the non-repetitive sequence of characters on the program card that is to be placed in the memory pile such that the series of cards in the memory pile are arranged in a non-repetitive sequence that corresponds to any one of the sequence of series of characters on the program card, or, if not, then placing the drawn input card into a temporary storage area in one of at least two series of temporarily stored input cards; fourth, drawing a second input card from the input card draw pile and placing it in the memory pile if the character on the second input card corresponds to the next character in order in any one of the non-repetitive sequence of characters on the program card, and then taking one or more cards from the temporarily stored input cards in the temporary storage area and placing the one or more input cards in one of the memory piles if the one or more input cards in the temporary storage area has a character printed thereon that corresponds to the next character in order in the non-repetitive sequence of any of the series of characters printed on the program card, or placing the second drawn input card into the temporary storage area in one of the at least two series of drawn input cards; and, fifth, continuing to draw input cards from the input card draw pile and playing the input cards as described above until there are no more input cards to draw and no more input cards remain or can be played from the temporary input storage area.

In accordance with yet another aspect of the present invention, the characters on the input cards and the program cards are Arabic numerals.

BRIEF DESCRIPTION OF THE DRAWINGS

The foregoing and other features of the present invention will be more readily appreciated as the same becomes better understood by reference to the detailed description when taken in conjunction with the following drawings, wherein.

DETAILED DESCRIPTION OF THE PREFERRED EMBODIMENT

The present invention is directed to card game components and method of playing the card game that is specifically designed for educating and intellectually stimulating a single player. More particularly, in order to enhance its educational value, the card game employs terminology that is found in the computer programming industry. However, it is to be appreciated that terminology from other industries can be used to focus the player on a particular profession, job classification, or task. The components of the present invention include a playing board, a set of playing cards, and a set of instructions and program cards.

Figure 1:
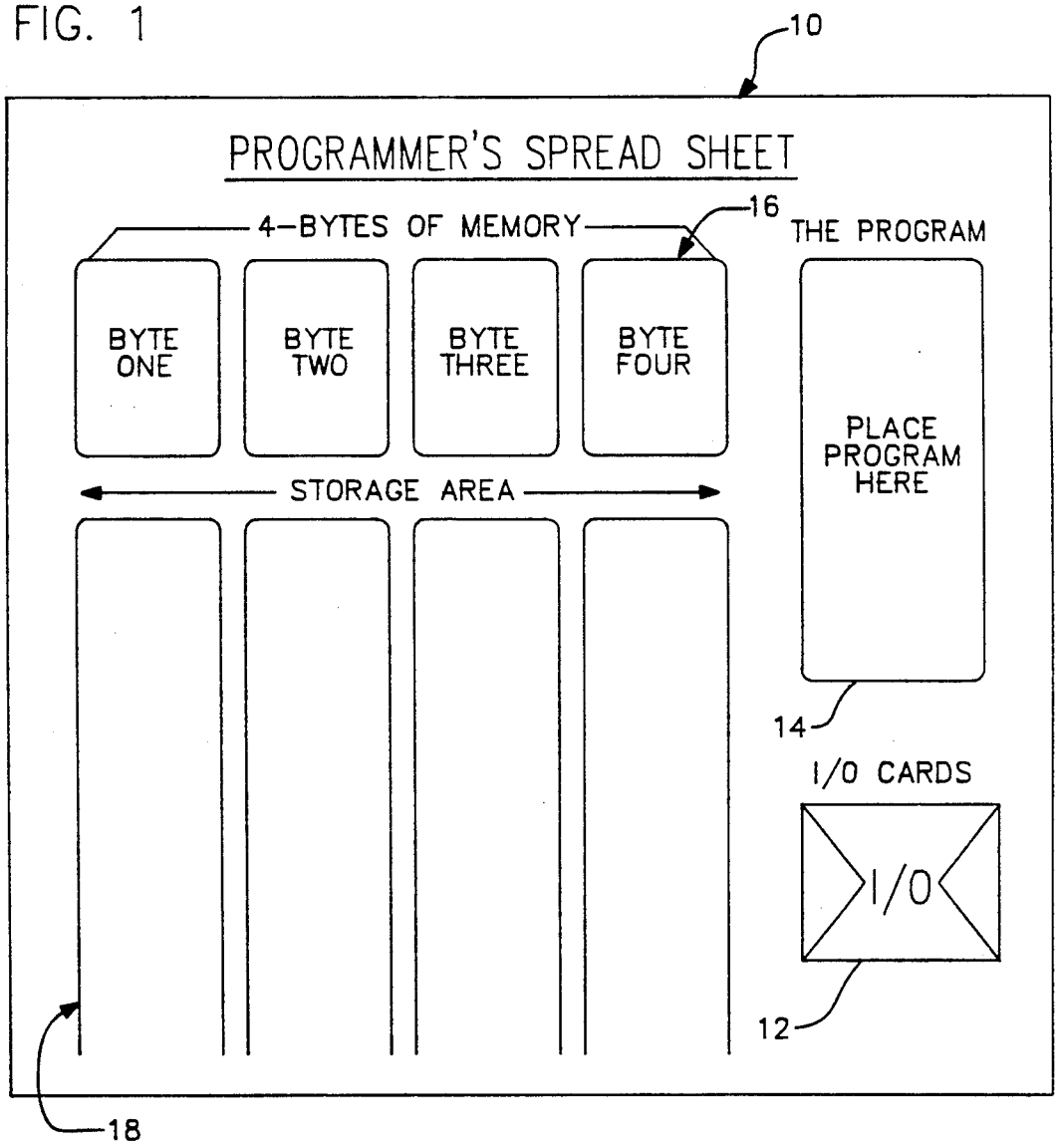
FIG. 1 is a plan view of the playing board formed in accordance with the present invention.

Turning initially to FIG. 1, the playing board 10 is identified as a Programmer's Spread Sheet. The playing board 10 is divided into four areas, a draw pile area 12, a program card area 14, a memory area 16, and a temporary storage area 18. The playing board 10 preferably is constructed of rigid cardboard or plastic material that can be folded, if necessary, to be stored inside a box, bag, or other suitable protective covering. Although the board 10 is shown as white with black lines, other colors may be used.

The draw pile area 12 is identified by the legend "I/O Cards," which stands for Input/Output Cards. For purposes of description, however, this will be shortened to "input cards." The draw pile area 12 is located in the lower right-hand corner of the playing board 10 and is sized to hold a stack of input cards.

The program card area 14 is located immediately above the draw pile area 12 and is rectangularly shaped and sized to hold one or more program cards. The program card area 14 is identified by the legend "The Program".

To the left of the program card area 14 and at the top of the playing board 10 is the memory area 16 comprising four small rectangular-shaped segments 20 placed side by side. Each segment 20 is the size and shape of an input card and are identified respectively as "BYTE ONE," "BYTE TWO," "BYTE THREE," and "BYTE FOUR." The memory area 16 itself is identified with the legend "4-Bytes of Memory."

The temporary storage area 18 is located immediately below the memory area 16 and comprises four elongate rectangular columns 22. Each column 22 has a width substantially equal to the width of a segment 20. The temporary storage area 18 is identified by the legend "Storage Area."

FIGS. 2–6 will now be described together. Each figure illustrates a program card 24 that is rectangularly shaped with an identifying legend 26 at the top that reads "Program." Below the legend 26 is a subtitle 28 that reads "Byte." Below the subtitle on each program card 24 are listed four columns of numbers, with each column labeled respectively "one," "two," "three," and "four." Each column 30 contains a series of thirteen characters 32, in this case Arabic numerals. The order of the characters 32 in each column 30 is determined by mathematical operation, as will be described more fully below.

FIGS. 7A–7M illustrate a series of thirteen input cards 34 having a character 36 printed on the face 38 thereof. The back of each input card 34 has a design similar to the design of the draw pile area 12 shown in FIG. 1 with the two black triangular areas on each side and the capital letters I and O separated by a slash in the center. Turning again to FIGS. 7A–7M, each input card 34 has a character 36 printed in the upper left-hand corner and the lower right-hand corner. In the center of each input card 34 is printed a number of interconnected boxes 40 with the number of boxes corresponding to the number represented by the character 36. Finally, along the sides 42 of each card 34 are placed six horizontal index lines 42 projecting horizontally inward from the edge of the card 34 a short distance. The horizontal index lines 42 and square boxes 40 are divided into centimeters. Thus, one centimeter between each horizontal line and square boxes of one square centimeter each provide an additional educational feature within this game.

It is critical that the characters 32 on the program cards 24 and the characters 36 on the input cards 34 be selected from a series of characters or symbols having a fixed order of arrangement, such as an alphabet, a number scale, or other series of identifiable indicia such as Morse code, a deck of face cards, signal flags, etc. In this case, since the emphasis of the game is on computer programming, Arabic numerals are used.

As can be seen, the characters 36 on the input cards 34 and the characters 32 on the program cards 24 are identical matches. In order for the game to be playable, it is important that the series of thirteen characters on the input cards 34 be identical to the series of thirteen characters 32 used on the program cards 24, since one object of the game is to have the player arrange the input cards 34 so that their characters 36 are in the order of arrangement of the characters 32 on the program cards 24.

Figure 2:
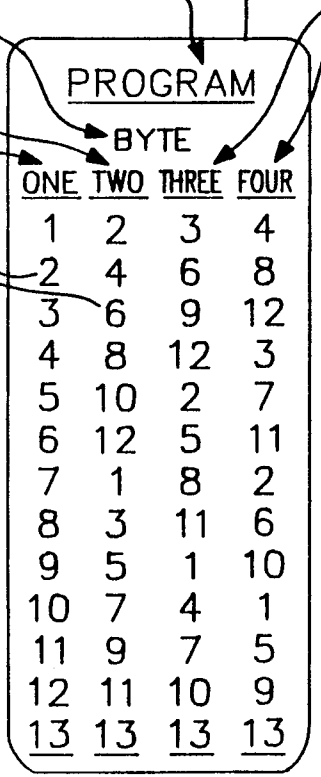
FIGS. 2–6 are plan views of program cards formed in accordance with the present invention.
Figure 3:
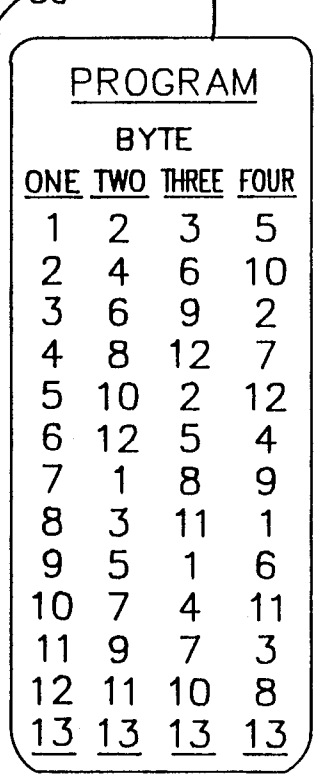
Figure 4:
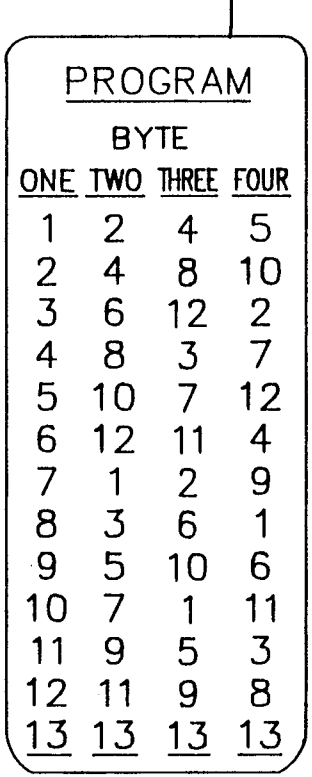
Figure 5:
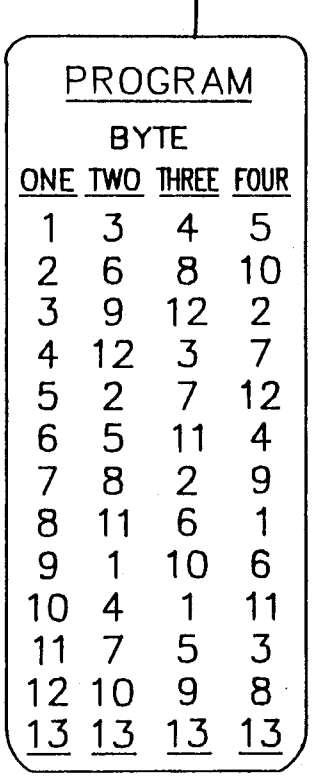
Figure 6:
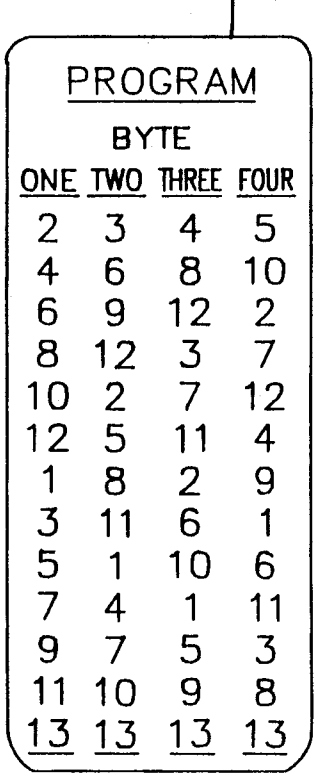
Figure 7A:
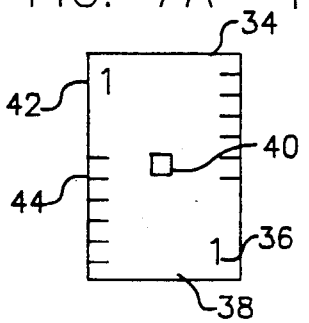
FIGS. 7A–7M are plan views of input cards formed in accordance with the present invention.
Figure 7B:
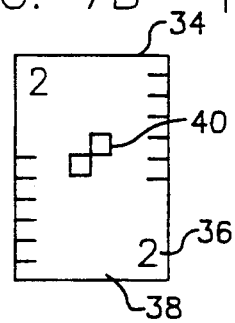
Figure 7C:
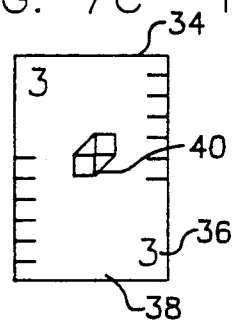
Figure 7D:
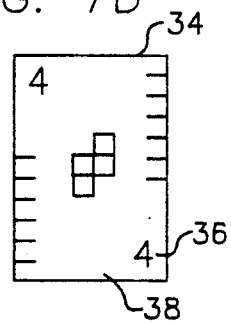
Figure 7E:
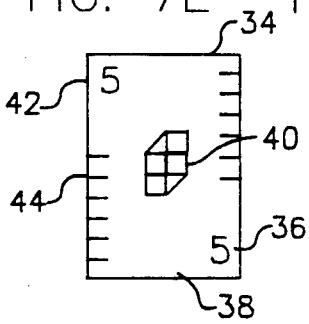
Figure 7F:
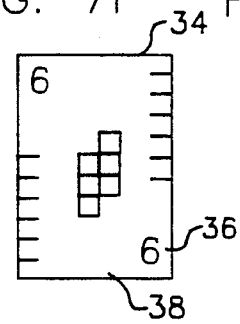
Figure 7G:
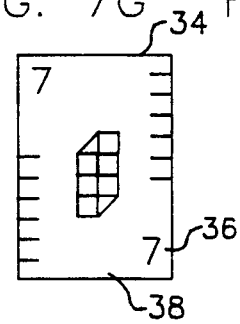
Figure 7H:
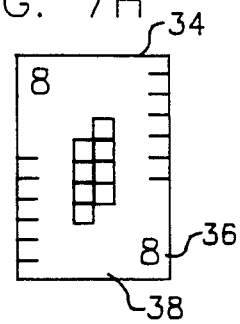
Figure 7I:
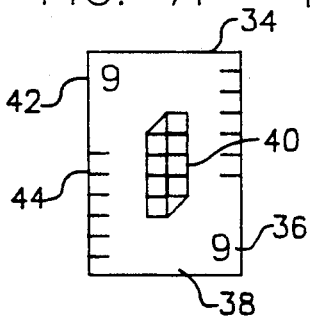
Figure 7J:
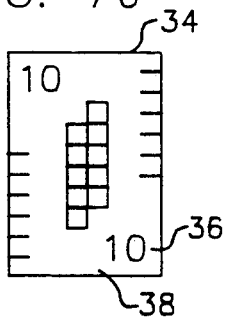
Figure 7K:
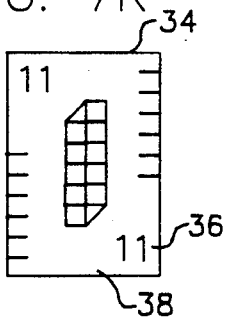
Figure 7L:
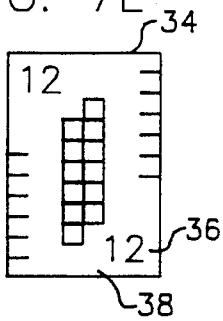
Figure 7M:
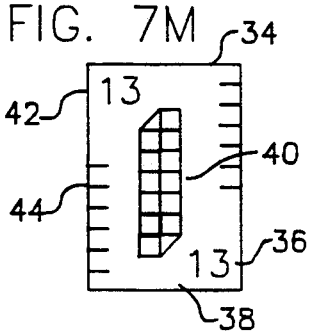

As can be seen on each of the program cards 24 in FIGS. 2–6, each column 30 consists of a series of numbers arranged in a non-repetitive sequence, with each series having a sequence that is unique from the other series on the same program card 24. As can be seen in FIG. 2, column one consists of the numbers 1 through 13 arranged in ascending order. Column two consists of the numbers 1 through 13 beginning with the number 2 and arranged in ascending order, with each succeeding number being separated from a previous number by the value of the first number in the series, in this case 2. The third column 30 consists of the numbers 1 through 13 arranged in ascending order beginning with the number 3, with each succeeding number being separated from the previous number by a factor of three. Finally, the fourth column consists of the numbers 1 through 13 arranged in ascending order beginning with the number 4, with each succeeding number being separated from the previous number by a factor of four. Each column ends with the number 13, which is the highest number in the series.

It will be noted that in columns two, three, and four, of the program card 24 illustrated in FIG. 2, the ascending series of numbers initially ascend until the next number in the ascending order would be greater than 13. For instance, in column number two, after the number 12, the next number in the ascending order would be 12+2, which equals 14; however, the next number listed is the number 1. In this case, the number 1 was determined by adding the factor of 2 to 12 to equal 14. Since this is greater than the highest number of the selected series, 13, the number 13 is subtracted from 14 to yield the number 1. This series then continues to ascend from the number 1 by a factor of two until the final number 13 is reached.

In column three, this process of reverting back to the beginning of the series occurs twice. As will be noted, the series initially commences at the number 3, proceeds to 6 and 9, and then reaches the number 12. If the factor of three is added to the number 12, the sum of the two equals 15. Since 13 is the highest number of the series, the next succeeding number will not be 15 but rather is the difference between 15 and 13, which in this case is the number 2. The series again continues from the number 2 and ascends until it reaches 11, where the next succeeding number in ascending order would be 14. Again, 13 is subtracted from 14 to yield the difference, 1. The series again continues to ascend from the number 1 until it reaches the number 13, where it concludes.

Finally, the same thing occurs in column four, except in this case the next succeeding number after 12 will be 16. Thirteen is subtracted from 16 to yield 3, which becomes the next number. This series continues to ascend again from the number 3 until the number 11 reached, where the process of determining the next number is repeated as described above.

The result of this manipulation of the characters is that each of the columns 30 yields a series of numbers that has a unique order of arrangement that is not repeated in any of the other series. In addition, the last character in each series on the program cards 24 is the last character of the original series. The program cards 24 in FIGS. 3–6 are different than the program card 24 in FIG. 2 in that each of the columns 30 has a unique set of beginning numbers, which thus determines the spacing between the series of numbers. Consequently, each program card 24 provides four series of characters in non-repeating sequence that is unique from any other program card 24.

Each series of characters on the program cards 24 is not limited to the series encompassed by the numbers 1 through 13. It is possible to use four series of numbers that begin at a different point on the number scale and encompass thirteen consecutive numbers. For instance, the series may begin with the number 11 and conclude with the number 23. If this were the case, the program card 24 illustrated in FIG. 2 would have column one beginning with the number 11 and ascending in order to the number 23. Column two would begin with the number 12 and ascend to the number 22, where it then would drop down to the number 11 and commence ascending again by a factor of two until the number 23 is reached. The other two columns would also have the series of numbers arranged in the same pattern.

In this case, since the series of characters begins somewhere other than at the first character, an additional step in calculating the series of the characters must be done. For instance, in column two the numbers ascend by a factor of two since 12 is the second character in the original series. When the number 22 is reached, the next number in order would be 24. However, the number 23 is subtracted from the number 24 to yield the number 1. The additional step required at this point involves adding the number 1 to the number preceding the first number of the series, in this case the number 10. The sum of that addition then becomes the next number, in this case 11. The sequence then continues ascending by a factor of two until the number 23 is reached.

Again, by way of example, column three would begin with the number 13 and ascend by a factor of three until the number 22 is reached. Since the next number in the ascending order would be 25, the number 23 is subtracted from 25 to yield the difference of 2. This difference is then added to the number preceding the number 11, which is 10, to yield the sum of 12. The series then continues from the number 12 and ascends by a factor of three until the number 21 is reached. Since the next number in the ascending order would be 24, which is greater than the highest number of this series, 23, the difference between the two, 1, is added to the number 10 to yield 11, which becomes the next number. The series again continues to ascend from the number 11 until the number 23 is reached. The same is true in column four beginning with the number 14, as described above.

Characters other than numbers may also be used to form the series. For instance, if the alphabet were selected, the letters A through M, which are the first thirteen characters in the alphabet, would be listed in column one on program card 24 of FIG. 2. In column two, the letter B would begin the series. The next letter in order after B is calculated based on the numerical relationship of B to the beginning of the series. In other words, since B is the second letter of the series, then every second letter after B is the factor by which the series ascends. Thus, if B is the first letter, the second letter after B, in this case D, will be the next letter. Likewise, the letter F, which is the second letter in order after D, will be the next letter in the series. This series continues to ascend until the letter L is reached. The next letter in ascending order after L would be the letter N. Since this letter is beyond the last letter in the series, M, the next letter will have to be calculated in accordance to its relationship with the first letter of the series. In other words, since the letter N is the fourteenth letter in the original series of alphabetical letters, then thirteen will be subtracted from fourteen to come up with the position number of the next character in order. In this case, the difference of thirteen from fourteen is one, which will be the position number of the next character in order. In the series of alphabetical letters, the first position is occupied by the letter A, which will then become the next letter in order after the letter L. This series will again continue to ascend by a factor of two until it concludes with the letter M.

A general rule can be stated in accordance with the present invention to construct a unique series of characters from any series of characters that has a fixed order of arrangement. Since each character in a series of characters having a fixed order of arrangement will have a fixed position in relationship to the first character in the series, that fixed position is always denoted by a position number. For instance, the first character will have a position number of one. The second character will have a position number of two. The first character that is selected to begin a column on the program card will determine the spacing of the characters by its position number, in this case the position number is denoted by the letter n.

Thus, if the first character in the column has the position number n in the original series of characters, the next character in order in the non-repetitive sequence will correspond to the position number of the sum of n+n. The position number of each succeeding character in the non-repetitive sequence is determined by adding the position number n of the first character to the position number of the previous character in the non-repeating sequence. However, when the position number sum is greater than the position number of the thirteenth character in the original series of characters, then the position number of the next succeeding character in the non-repetitive sequence will correspond to the difference of the position number sum of the next character in order and the position number of the thirteenth character in the series of characters having a fixed order of arrangement, with the difference being added to the position number of the character preceding the first character in the original series of characters. If the original series of characters begins with the very first character in that series, then the preceding character will have a position number of zero.

Turning again to FIG. 1, the method of playing the game will now be described. First, all of the input cards 34 are shuffled until they are placed in a random order. The cards are placed in a pile on the draw pile area 12 of the playing board 10. A program card 24 is selected and placed in the program card area 14. Play commences with the player drawing an input card 34 from the input card draw pile area 12. The character 36 on the input card 34 is examined and, if the character corresponds to any of the four leading characters at the top of the columns 30 on the program card 24, then that input card 34 is placed in the corresponding segment 20 of the memory area 16. For instance, if the program card 24 illustrated in FIG. 2 has been placed in the program card area 14 and the first card drawn has the number 3 on its face 38, then that card would be placed in the segment 20 having the legend "BYTE THREE." However, if the character 36 on the input card 34 is not identical to the first character in any of the columns 30 on the program card 24, it is then placed in one of the columns 30 of the temporary storage area 18.

Play continues with the player drawing a second card from the input card draw pile area 12 and determining from the program card 24 if the character 36 on the input card 34 is the next character to be placed in the memory area 16. If it is, the input card 34 is so placed. At this point, if the input card in the temporary storage area 18 can now be played, it then is taken from the temporary storage area 18 and placed where it belongs in the memory area 16. If not, the card 34 remains in the temporary storage area 18 until it can be played.

The player then continues to draw cards from the draw pile area 12. Cards not playable in the memory area 16 are placed in the temporary storage area 18 by being set on top of any cards currently stored in the temporary storage area 18. Cards may be taken from the temporary storage area 18 only if they have not been covered by another card and they have a character 36 thereon that corresponds to the next character to be played in the memory area 16 as determined by the four columns of characters on the current program card 24 in the program card area 14. The player continues to draw input cards 34 from the input card draw pile area 12 and playing the input cards 34 as described above until there are no more input cards 34 to draw and there are no input cards 34 that remain or that can be played from the temporary storage area 18.

A player successfully completes the game if all of the cards drawn from the draw pile area 12 are placed in the memory area 16 in the order listed on the program card 24 in the program card area 14. It is possible that after all the cards from the draw pile area 12 have been drawn by the player, that the four top cards in the temporary storage area 18 may not have a character 36 that is playable in one of the four segments 20 in the memory area 16 in which case play stops.

It has been found that a player can use a strategy that will enable him to have a high successful completion rate when playing the game. This strategy requires that input cards 34 be placed in the temporary storage area in the reverse order in which they occur on the program card 24, thus enabling the player to take cards from the temporary storage area 18 as the memory area 16 fills up. As such, it can be seen that the game requires a high degree of concentration and planning in order to successfully complete its objective.

As will be readily appreciated from the foregoing description, the present invention is directed to a card game that can be played by an individual as a solitaire game or used as a mental exercise to develop concentration and to illustrate the basic principles of logic. The present invention can also be used in a classroom environment to demonstrate these analytical abilities and to illustrate the principles of strategy building and advanced planning. In both cases, as can be seen from the foregoing description, the overall design of the game is illustrative of the basic art of programming a computer.

While a preferred embodiment of the invention has been illustrated and described, it is to be understood that various changes can be made therein without departing from the spirit and scope of the present invention. Consequently, the invention is to be limited only by the scope of the claims that follow.

The embodiments of the invention in which an exclusive property or privilege is claimed are defined as follows:

1. Card game playing components comprising:

at least two matching series of input cards, each of said input cards in a series having a unique character thereon;

at least one program sheet having at least two series of characters thereon, each character in each of said series being identical to each of said characters on said input cards, each of said series of characters on said program sheet being arranged in a non-repetitive sequence that is unique from the other of said at least two series of characters; and a gameboard having a playing face, said playing face being sized and shaped to accommodate at least four play locations delineated thereon, a first play location denoted to receive a randomly sorted stack of said at least two series of input cards, a second play location denoted to receive said program sheet, a third play location denoted to receive at least two stacks of temporarily discarded input cards, and a fourth play location denoted to receive said at least two series of input cards that are arranged in overlapping relationship such that each series can be segregated from the other of said at least two series of input cards with said input cards in each series displayed in the non-repetitive sequence corresponding to a non-repetitive sequence on said program sheet.

2. The card game playing components of claim 1, wherein each series of characters on said at least two series of input cards and each of said at least two series of said characters on said program sheet comprise thirteen characters in a series.

3. The card game playing components of claim 2, wherein each character in each of said series on said program sheet is one of an original series of characters that has a fixed order of arrangement such that each character has a fixed position in relationship to a first character of said series, said fixed position being denoted by a position number, and further wherein each series of said characters on said program sheet is arranged in a non-repetitive sequence that begins with a first character having a position number n in said original series of characters, and the next character in said non-repetitive sequence corresponds to the position number of the sum of n+n in said original series of characters, and further wherein the position number of each succeeding character in said non-repetitive sequence is determined by adding the position number n of said first character to the position number of the previous character in said non-repetitive sequence; except that when the position number sum is greater than the position number of the thirteenth character in said original series of characters, then the position number of said succeeding character in said non-repetitive sequence will correspond to the difference of the position number sum and the position number of the thirteenth character in said series of characters having a fixed order of arrangement, with said difference being added to the position number preceding the first character of said original series of characters.

4. Card game playing components for a card game to be played by a single player, said card game playing components comprising:

at least two series of input cards, each of said series comprising thirteen input cards, and each of said input cards in a series having a unique character printed thereon;

at least one program card having at least two series of thirteen characters, each arranged in a non-repetitive sequence printed thereon, each character in said at least two series of thirteen characters on said at least one program card being identical to one character on an input card in each of said at least two series of said input cards; and, a playing board divided into at least four areas, said areas comprising a first area sized and shaped to receive said at least one program card; a second area sized and shaped to receive a pile of randomly sorted input cards; a third area sized and shaped to hold at least two piles of discarded input cards; and a fourth area sized and shaped to receive said at least two series of input cards arranged in overlapping relationship such that said character on each input card is at least partially visible to the player.

5. The card game playing components of claim 4, wherein each character in each of said series on said at least one program card is one of an original series of characters that has a fixed order of arrangement such that each character has a fixed position in relationship to a first character of said series, said fixed position being denoted by a position number, and further wherein each series of said characters on said at least one program card is arranged in a non-repetitive sequence that begins with the first character having a position number n in said original series of characters, and the next character in said non-repetitive sequence corresponds to the position number of the sum of n+n in said original series of characters, and further wherein the position number of each succeeding character in said non-repetitive sequence is determined by adding the position number n of said first character to the position number of the previous character in said non-repetitive sequence; except that when the position number sum is greater than the position number of the thirteenth character in said original series of characters, then the position number of said succeeding character in said non-repetitive sequence will equal the difference of the position number sum and the position number of the thirteenth character in said series of characters having a fixed order of arrangement, with said difference being added to the position number preceding the position number of the first character of said original series of characters.

6. A card game playing method wherein the card game components include at least two series of input cards, each series of said input cards having at least thirteen cards with each card having a unique recognizable character printed thereon that matches one character in each of the other series of the at least two series, and a program card having at least two series of characters printed thereon in a non-repetitive sequence with each of the characters on the program card matching one character in each series of characters on the input cards, the method of playing the card game comprising the steps of:

selecting a program card;

mixing the input cards into a random order of arrangement and placing them into an input card draw pile;

drawing a first input card from the input card draw pile;

placing the drawn input card into a memory pile if the character on the drawn input card corresponds to the next character in the non-repetitive sequence of characters on the program card to be placed in the memory pile such that the series of cards in the memory pile are arranged in a non-repetitive sequence that corresponds to the sequence of any one of the series of characters on the program card or, if not, then placing the drawn input card into a temporary storage area in one of at least two series of temporarily stored input cards;

drawing a second input card from the input card draw pile and placing it in the memory pile if the character on the second input card corresponds to the next character in order in any one of the non-repetitive sequence of characters on the program card; and then taking one or more input cards from the at least two series of temporarily stored input cards in the temporary storage area and placing the one or more input cards in one of the memory piles if the one or more input cards in the temporary storage area has a character thereon that corresponds to the next character in order in the non-repetitive sequence of characters printed on the program card; or, if not, placing the second drawn input card into the temporary storage area in one of the at least two series of drawn input cards; and, continuing to draw input cards from the input card draw pile and playing the input cards as described above until there are no more input cards to draw and no input cards remain or can be played from the temporary storage area.

7. The card game playing method of claim 6, wherein the step of placing the drawn input card into a temporary storage area further includes the step of placing the drawn input card on top of the top input card in one of the at least two series of temporarily stored input cards in the temporary storage area in at least an overlapping relationship.

8. The card game playing method of claim 7, wherein the step of drawing input cards from the temporary storage area further includes the step of drawing only the top exposed card from the at least two series of temporarily stored input cards in the temporary storage area.

* * * * *